US008196426B2

(12) United States Patent
Kang

(10) Patent No.: US 8,196,426 B2
(45) Date of Patent: Jun. 12, 2012

(54) REFRIGERATOR DISPENSER CONTROL TECHNOLOGY

(75) Inventor: Dae-Jone Kang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 768 days.

(21) Appl. No.: 12/399,113

(22) Filed: Mar. 6, 2009

(65) Prior Publication Data

US 2009/0254221 A1 Oct. 8, 2009

(30) Foreign Application Priority Data

Apr. 7, 2008 (KR) ..... 10-2008-0032352

(51) Int. Cl.
*F25B 3/00* (2006.01)

(52) U.S. Cl. ..... 62/389

(58) Field of Classification Search ..... 62/389, 62/449; 220/146.6; 700/275
See application file for complete search history.

(56) References Cited

U.S. PATENT DOCUMENTS

| | | | | |
|---|---|---|---|---|
| 7,228,701 | B2 * | 6/2007 | Kim | 62/338 |
| 2006/0201194 | A1 | 9/2006 | Bowen et al. | |

FOREIGN PATENT DOCUMENTS

| | | |
|---|---|---|
| KR | 10-0223424 | 7/1999 |
| KR | 2003-0057816 | 7/2003 |
| KR | 10-2005-0028360 | 3/2005 |
| KR | 10-2008-0068173 | 7/2008 |

OTHER PUBLICATIONS

Korean Notice of Allowance issued in Korean Patent Application No. 10-2008-0032352, dated Jul. 1, 2009, 2 pages.

* cited by examiner

*Primary Examiner* — Melvin Jones
(74) *Attorney, Agent, or Firm* — Fish & Richardson P.C.

(57) ABSTRACT

Refrigerator dispenser control technology, in which user input related to moving a dispensing unit between a received position and a dispensing position is received and it is detected whether a dispensing unit is oriented in the received position or the dispensing position. The dispensing unit is driven based on the user input and the detection of whether the dispensing unit is oriented in the received position or the dispensing position. The dispensing unit may be driven from the received position to the dispensing position based on detecting that the dispensing unit is oriented in the received position. The dispensing unit also may be from the dispensing position to the received position based on detecting that the dispensing unit is oriented in the dispensing position.

25 Claims, 9 Drawing Sheets

REFRIGERATOR DISPENSER CONTROL TECHNOLOGY

CROSS REFERENCE TO RELATED APPLICATIONS

This application claims the benefit of Korean Patent Application No. 10-2008-0032352, filed on Apr. 7, 2008, which is hereby incorporated by reference for all purposes as if fully set forth herein.

FIELD

The present disclosure relates to refrigerator dispenser control technology.

BACKGROUND

In general, a refrigerator is a device that preserves items, such as food or beverages, in storage in a cool or frozen state by using cool air generated by a refrigerating cycle. A refrigerator may include an ice maker configured to make ice and a dispenser configured to dispense liquid water and ice made by the ice maker.

SUMMARY

In one aspect, the disclosure relates to a method for controlling a refrigerator having a dispenser that includes a dispensing unit that is configured to move between a received position at which a dispenser outlet of the dispensing unit is positioned on a side of a surface of a refrigerator door where a compartment opened and closed by the refrigerator door is positioned and a dispensing position at which the dispenser outlet of the dispensing unit is positioned on a side of the surface of the refrigerator door opposite of the compartment. The method includes receiving user input related to moving the dispensing unit between the received position and the dispensing position, and detecting whether the dispensing unit is oriented in the received position or the dispensing position. The method also includes driving the dispensing unit based on the user input and the detection of whether the dispensing unit is oriented in the received position or the dispensing position. Driving the dispensing unit includes at least one of driving the dispensing unit from the received position to the dispensing position based on detecting that the dispensing unit is oriented in the received position, and driving the dispensing unit from the dispensing position to the received position based on detecting that the dispensing unit is oriented in the dispensing position.

Implementations may include one or more of the following features. For example, the method may include determining a rotation direction signal based on whether the dispensing unit is oriented in the received position or the dispensing position and transferring an operation initiation signal and the rotation direction signal to a driving unit that is configured to drive the dispensing unit. In this example, the method may include determining a first rotation direction signal that is configured to inspire rotation, by the driving unit, of the dispensing unit in a direction from the received position to the dispensing position conditioned on detecting that the dispensing unit is oriented in the received position and determining a second rotation direction signal that is configured to inspire rotation, by the driving unit, of the dispensing unit in a direction from the dispensing position to the received position conditioned on detecting that the dispensing unit is oriented in the dispensing position.

The method also may include receiving at least one of a user input command to move the dispensing unit to the dispensing position and a user input command to move the dispensing unit to the received position, and driving the dispensing unit from the received position to the dispensing position based on receiving the user input command to move the dispensing unit to the dispensing position and detecting that the dispensing unit is oriented in the received position. The method further may include driving the dispensing unit from the dispensing position to the received position based on receiving the user input command to move the dispensing unit to the received position and detecting that the dispensing unit is oriented in the dispensing position. In addition, the method may include maintaining the dispensing unit in the dispensing position without driving the dispensing unit based on receiving the user input command to move the dispensing unit to the dispensing position and detecting that the dispensing unit is oriented in the dispensing position. The method may include maintaining the dispensing unit in the received position without driving the dispensing unit based on receiving the user input command to move the dispensing unit to the received position and detecting that the dispensing unit is oriented in the received position.

Further, the method may include receiving a user input command to move the dispensing unit to the dispensing position, detecting that the dispensing unit is oriented in the dispensing position, and maintaining the dispensing unit in the dispensing position without driving the dispensing unit based on receiving the user input command to move the dispensing unit to the dispensing position and detecting that the dispensing unit is oriented in the dispensing position. The method may include receiving a user input command to move the dispensing unit to the received position, detecting that the dispensing unit is oriented in the received position, and maintaining the dispensing unit in the received position without driving the dispensing unit based on receiving the user input command to move the dispensing unit to the received position and detecting that the dispensing unit is oriented in the received position.

Moreover, the method may include receiving a user input command to move the dispensing unit to the dispensing position, detecting that the dispensing unit is oriented in the received position, and driving the dispensing unit from the received position to the dispensing position based on receiving the user input command to move the dispensing unit to the dispensing position and detecting that the dispensing unit is oriented in the received position. The method may include receiving a user input command to move the dispensing unit to the received position, detecting that the dispensing unit is oriented in the dispensing position, and driving the dispensing unit from the dispensing position to the received position based on receiving the user input command to move the dispensing unit to the received position and detecting that the dispensing unit is oriented in the dispensing position.

In some implementations, the method may include at least one of detecting whether the dispensing unit has been moved by an external force when the dispenser is oriented in the dispensing position and receiving a signal from an operation button unit located on a surface of the refrigerator door or the dispensing unit that is opposite of the compartment. In these implementations, the method may include detecting whether the dispensing unit has been moved by an external force when the dispenser is oriented in the dispensing position, and, in response to detecting that dispensing unit has been moved by an external force when the dispenser is oriented in the dispensing position, transferring a driving command to a driving unit that instructs the driving unit to move the dispensing unit to the received position. The method may include receiving a signal from an operation button unit located on a surface of the refrigerator door or the dispensing unit that is opposite of the compartment.

The method also may include, if the dispenser is detected to be oriented in the dispensing position, measuring an idle time during which the dispensing unit is oriented in the dispensing position and content has not been dispensed by the dispensing unit, accessing a stored threshold standby time, and comparing the idle time to the stored threshold standby time. Conditioned on the comparison revealing that the idle time is greater than the access threshold standby time, a driving command may be transferred to a driving unit that instructs the driving unit to move the dispensing unit to the received position. The method further may include detecting whether or not the refrigerator door is opened when the dispensing unit is detected to be oriented in the dispensing position. Conditioned on detecting that the refrigerator door is opened when the dispensing unit is detected to be oriented in the dispensing position, a driving command may be transferred to a driving unit that instructs the driving unit to move the dispensing unit to the received position.

In some examples, the method may include sensing whether a guide switch unit, that is activated by rotation of the dispensing unit moving between the received position and the dispensing position, is on or off, and sensing whether a dispensing switch unit, that is activated by a dispensing button unit configured to move, along with the dispensing unit, between the received position at which the dispensing button unit is positioned on the side of the surface of the refrigerator door where the compartment is positioned and the dispensing position at which at least a portion of the dispensing button is positioned on the side of the surface of the refrigerator door opposite of the compartment, is on or off. In these example, the method may include determining that the dispensing unit is positioned at the received position when the guide switch unit and the dispensing switch unit are sensed to be on, and determining that the dispensing unit is positioned at the dispensing position when the guide switch unit and the dispensing switch unit are sensed to be off.

Additionally, in these examples, the method may include transferring an operation initiation signal and a rotation direction signal to a driving unit that is configured to drive the dispensing unit, accessing a stored threshold time, and stopping the driving unit if an operation time of the driving unit exceeds the accessed threshold time. The method may include, after stopping the driving unit, determining an expected position of the dispensing unit based on the rotation direction signal, detecting a state of the guide switch unit and a state of the dispensing switch unit, and determining whether the dispensing unit is positioned at the expected position based on the detected states of the guide switch unit and the dispensing switch unit. The method may include determining that the dispensing unit is positioned in an unexpected position if the dispensing unit is expected to be oriented in the received position and at least one of the guide switch unit and the dispensing switch unit is detected to be in a state indicating that the dispensing unit is positioned at a position other than the received position.

The method also may include determining that the dispensing unit is positioned in an unexpected position if the dispensing unit is expected to be oriented in the dispensing position and at least one of the guide switch unit and the dispensing switch unit is detected to be in a state indicating that the dispensing unit is positioned at a position other than the dispensing position. In response to determining that the dispensing unit is positioned in an unexpected position, the driving unit may be controlled to move the dispensing unit to the received position.

In some implementations, the method may include determining an operational direction of the dispensing unit based on the rotation direction signal, detecting a state of the guide switch unit and a state of the dispensing switch unit at a certain period prior to the driving time exceeding the accessed threshold time, and determining whether or not the dispensing unit is in an abnormal state based on the states of the guide switch unit and the dispensing switch unit and the operational direction of the dispensing unit. In these implementations, the method may include determining that the dispensing unit is in an abnormal state if the dispensing unit is moving from the dispensing position to the received position and a state of the dispensing switch unit changes before a state of the guide switch unit changes. Also, in these implementations, the method may include determining that the dispensing unit is in an abnormal state if the dispensing unit is moving from the received position to the dispensing position and a state of the guide switch unit changes before a state of the dispensing switch unit changes.

In another aspect, a refrigerator includes a compartment and a refrigerator door configured to open and close at least a portion of the compartment. The refrigerator also includes a dispensing unit that is configured to move between a received position at which a dispenser outlet of the dispensing unit is positioned on a side of a surface of the refrigerator door where the compartment is positioned and a dispensing position at which the dispenser outlet of the dispensing unit is positioned on a side of the surface of the refrigerator door opposite of the compartment, and an input unit configured to receive user input related to moving the dispensing unit between the received position and the dispensing position. The refrigerator further includes a detection unit configured to detect whether the dispensing unit is oriented in the received position or the dispensing position and a driving mechanism configured to drive the dispensing unit based on the user input and the detection of whether the dispensing unit is oriented in the received position or the dispensing position. The driving mechanism configured to drive the dispensing unit by at least one of driving the dispensing unit from the received position to the dispensing position based on the detection unit detecting that the dispensing unit is oriented in the received position, and driving the dispensing unit from the dispensing position to the received position based on the detection unit detecting that the dispensing unit is oriented in the dispensing position.

DETAILED DESCRIPTION

Figure 1:
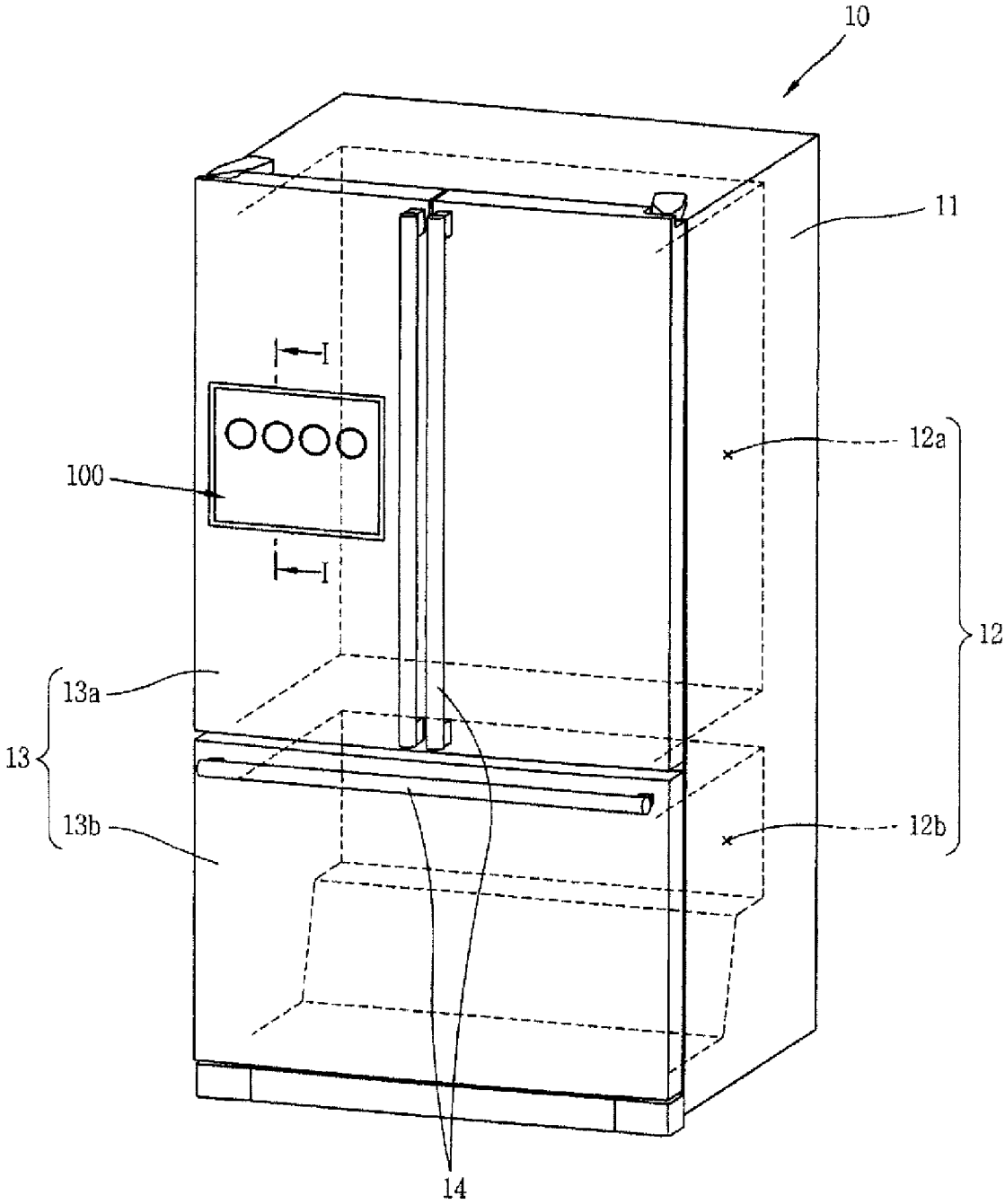
FIG. 1 is a view showing a refrigerator having a dispenser.
Figure 2:
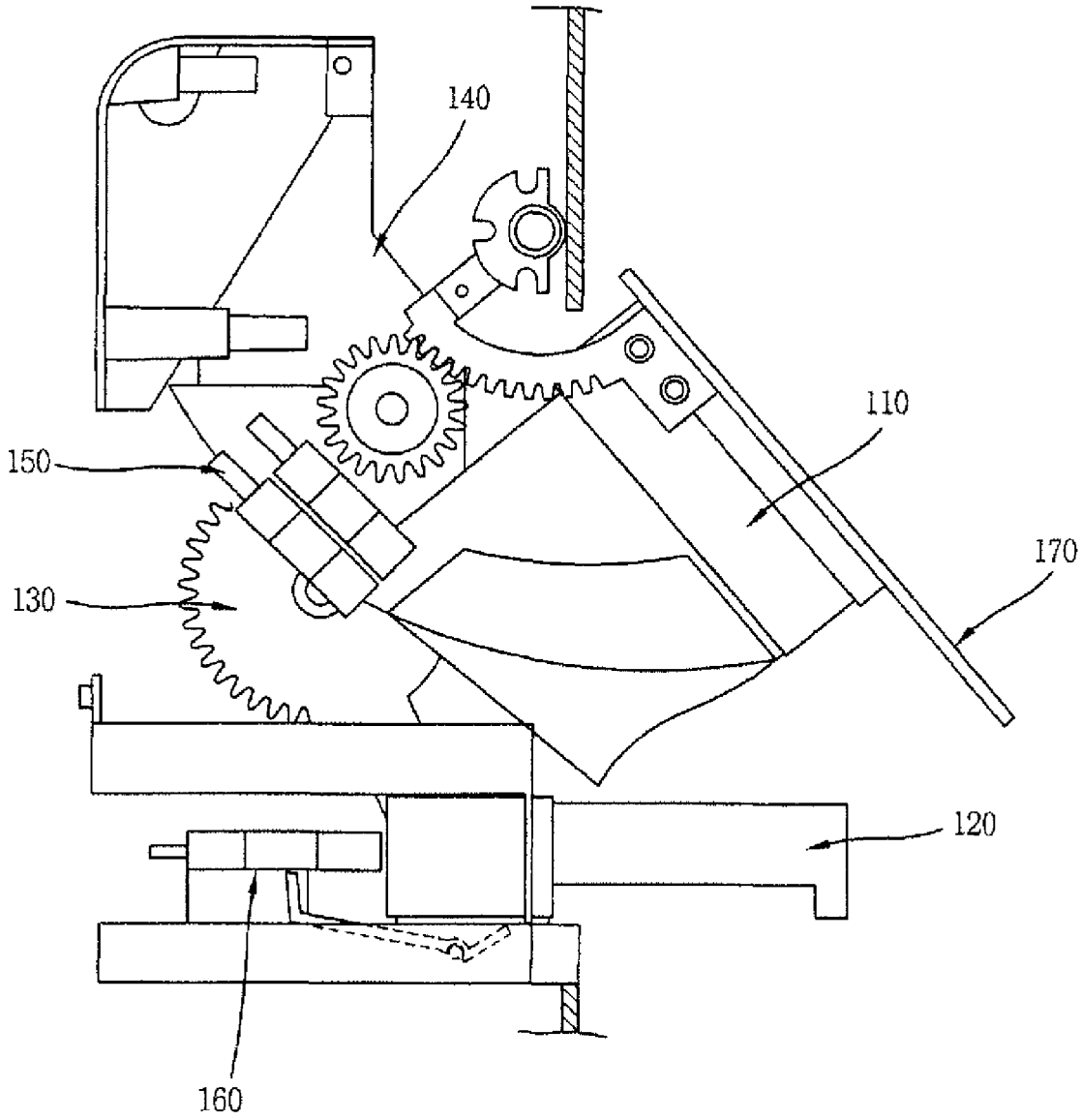
FIG. 2 is a side view of the dispenser in FIG. 1.

FIG. 1 illustrates a refrigerator having a dispenser, and FIG. 2 shows a side of the dispenser in FIG. 1.

With reference to FIGS. 1 and 2, a refrigerator 10 includes a cooling chamber 12 that stores storage items and a door 13 that shields the cooling chamber.

The cooling chamber 12 is positioned within a main body 11 that defines an external appearance of the refrigerator 10. A gap exists between an inner surface of the cooling chamber 12 and an outer surface of the main body 11, and a heat insulator is positioned within the gap.

The interior of the cooling chamber 12 is insulated from the exterior of the main body 11 by the heat insulator.

Also, one side of the cooling chamber 12 is exposed (e.g., vacant, opened, etc.) to allow items to be put in or taken out, and such one side is covered by a door 13 that is connected to the main body 11 by hinges that enable opening and closing of the door 13.

Because a heat insulator is inserted in the door 13, heat transfer to the cooling chamber 12 via the door 13 can be reduced.

A door handle 14 may be coupled to a portion of a front surface of the door 13 to allow a user to grasp it, and use the door handle 14 to open and close the door 13.

A refrigerating cycle (not shown) for generating cooling air to cool the cooling chamber 12 is provided at one side of the main body 11.

Several mechanisms exist for the construction and operation of the refrigerating cycle, and, therefore, a detailed description on the refrigerating cycle will be omitted. Any of mechanism may be used for the refrigerating cycle of the refrigerator 10.

The cooling air generated by the refrigerating cycle may be supplied to the cooling chamber 12 via a cooling air supply duct (not shown) formed within the main body 11 to cool the interior of the cooling chamber 12.

Of course, an air blower (not shown) may be provided to smoothly supply cooling air through the cooling air supply duct.

The cooling chamber 12 may include a refrigerating chamber 12*a* that freshly keeps storage items in storage without freezing them and a freezing chamber 12*b* that keeps storage items in a frozen state in storage for a long period.

Also, the refrigerating chamber 12*a* and the freezing chamber 12*b* may have various types of specific configurations (or structures) such that consumers may select the configuration they desire based upon how they use their refrigerator or based upon the types or amount of things (food) to be stored therein.

FIG. 1 shows an example of the refrigerator 10 in an ordinary operating orientation. For instance, as shown, when a support structure of the refrigerator 10 rests against the ground, the refrigerating chamber 12*a* is positioned at a relatively upper portion of the main body 11 and the freezing chamber 12*b* is positioned at a relatively lower portion of the main body 11. The ordinary operating orientation may reflect the intended orientation of the refrigerator 10 when being used by a consumer.

In some implementations, as shown in FIG. 1, because users typically access the refrigerating chamber 12*a* more than the freezing chamber 12*b*, the refrigerating chamber 12*a* may be provided at an upper portion and the freezing chamber 12*b* may be provided at a lower portion such that user convenience is improved. Also, a freezing chamber door 13*b* for opening and closing the freezing chamber 12*b* may be a pull-out drawer assembly (instead of a hinged assembly used in the refrigerating chamber door 13*a*) such that the user can place items into or remove items from the freezing chamber 12*b* more easily without having to strenuously bend down (or lower his posture) to access the freezing chamber 12*b*.

Alternatively, the freezing chamber 12*b* may be formed at the upper portion and the refrigerating chamber 12*a* may be formed at the lower portion. Of course, the refrigerating chamber 12*a* and the freezing chamber 12*b* may be horizontally oriented and positioned side by side.

A dispenser 100 is provided on the refrigerator 10 to dispense ice or the like made in the cooling chamber 12 from the exterior without opening the door 13.

FIG. 1 shows an example in which the dispenser 100 is provided on the refrigerating door 13*a*, but alternatively, the dispenser 100 may be provided on the freezing chamber door 13*b*.

In some implementations, the dispenser 100 includes a dispensing unit 110 that moves between a received position (closed configuration) at which the dispensing unit is received inwardly from a front surface of the door 13 and a dispensing position at which the dispensing unit is rotatably ejected in front of a front surface of the door 13 and positioned to dispense ice from the cooling chamber 12. The dispenser 100 also includes a dispensing button unit 120 which is covered by the dispensing unit 110 when the dispensing unit 110 is at the received position and ejected in front of a front surface of the door 13 by moving in association with a movement of the dispensing unit 110. The dispenser 100 further includes a driving unit 130, which controls movement of the dispensing unit 110 and the dispensing button unit 120.

The dispensing unit 110 communicates with a transfer unit 140 provided to allow ice or the like to be transferred therethrough from the cooling chamber 12.

In addition, the dispenser 100 may include an operation button unit 170 that receives user input and initiates operation of the dispenser 100. Here, the position of the operation button unit 170 may be provided at the dispensing unit 110 as shown in FIG. 2. Alternatively, the operation button unit 170 may be provided in other locations, such as a front surface of the door 13.

A guide switch unit 150 is positioned to be pressed or released according to movement of the dispensing unit 110. The guide switch unit 150 is configured to detect a state of the dispensing unit 110 based on whether the guide switch unit 150 is pressed or released. A dispensing switch unit 160 is positioned to be pressed or released according to movement of the dispensing button unit 120. The dispensing switch unit 160 is configured to detect a state of the dispensing button unit 120 based on whether the dispensing switch unit 160 is pressed or released.

Accordingly, when a dispense signal to dispense ice, water, or the like is detected through the operation button unit 170, the dispensing unit 110 and the dispensing button unit 120 are ejected. When ejected, the dispensing button unit 120 is pressed to dispense ice, water, or the like via the dispensing unit 110.

Figure 3:
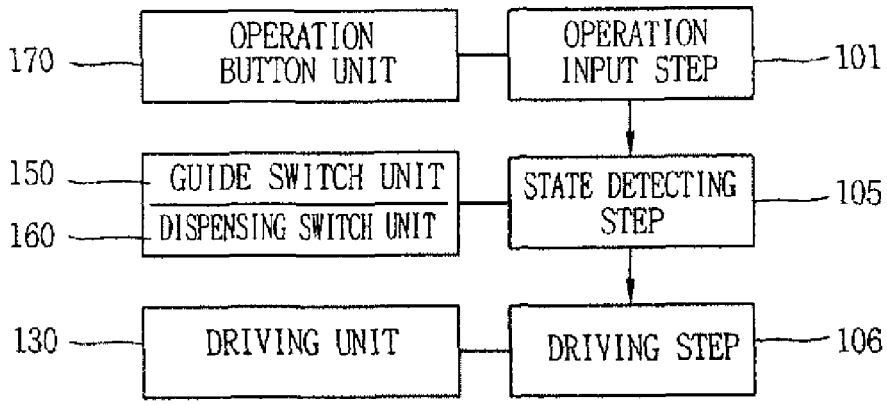
FIG. 3 is a block diagram showing a method for controlling a refrigerator having a dispenser.
Figure 4:
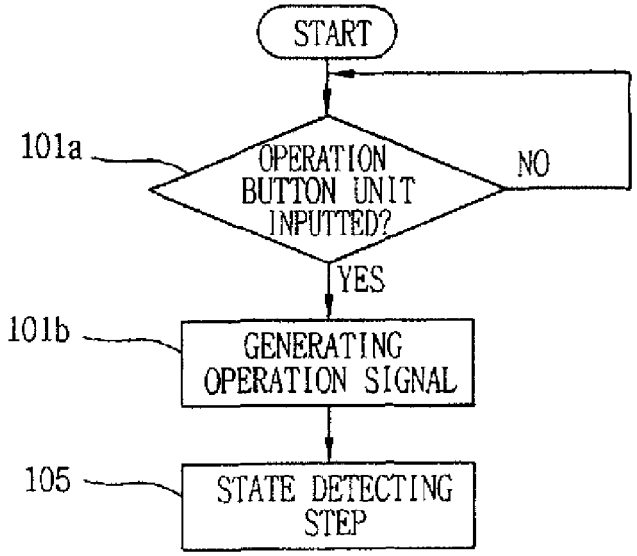
FIG. 4 is a flow chart illustrating an operation input process.
Figure 5:
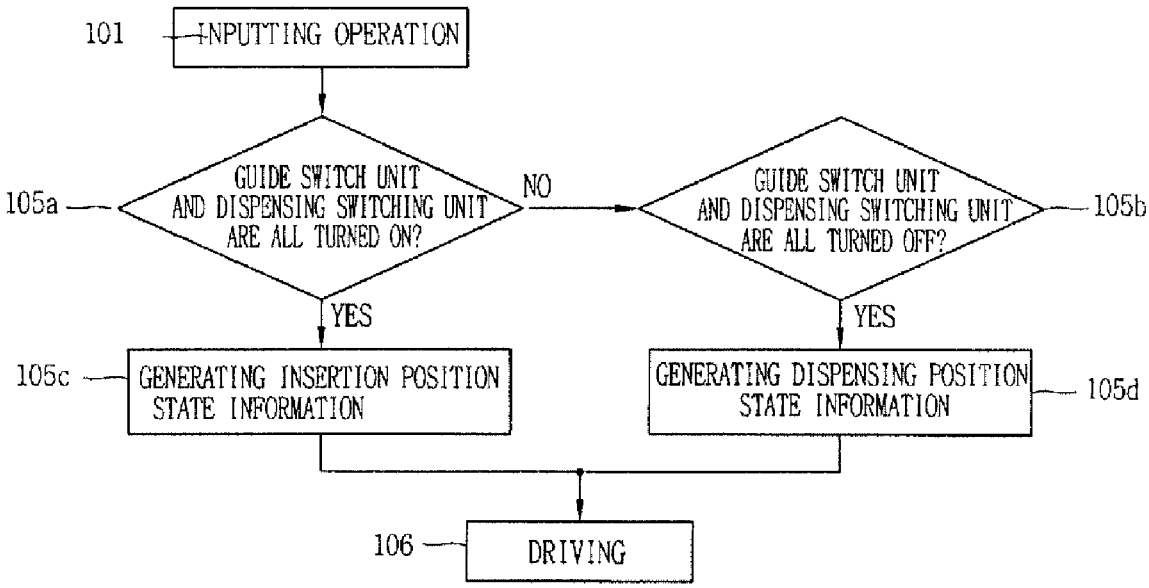
FIG. 5 is a flow chart illustrating a state detecting process.
Figure 6:
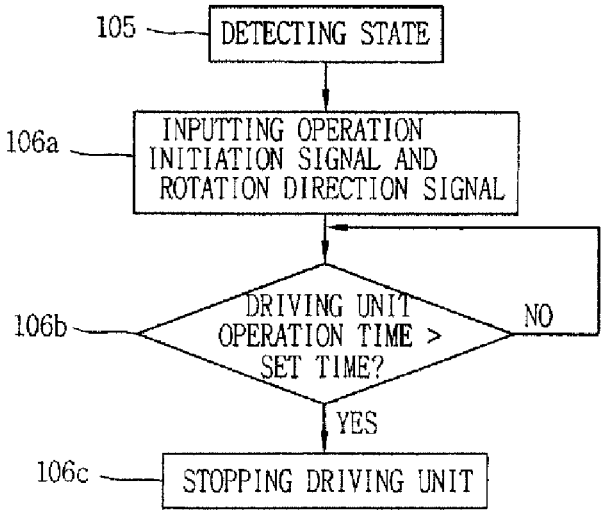
FIGS. 6-11 are flow charts illustrating examples of a driving process.

FIG. 3 shows a method for controlling a refrigerator having a dispenser, and FIG. 4 illustrates an operation inputting process. FIG. 5 illustrates a state detecting process, and FIG. 6 illustrates a driving process.

With reference to FIG. 3, the method for controlling a refrigerator having a dispenser includes an operation input step 101 in which an operation signal is received, a state detecting step 105 in which it is detected whether the dispenser 100 is at the received position or at the dispensing position, and a driving step 106 in which the dispenser 100 is driven based on the detected state information.

In the operation input step 101, an operation signal may be received from a user via the operation button unit 170 and transfers the same to the state detecting step 105.

Referring to FIG. 4, the operation input step 101 includes a step 101*a* in which a controller of the refrigerator detects whether or not the operation button unit 170 is pressed, and, when pressing of the operation button unit 170 is detected, an operation signal is generated in step 101*b* and then transferred to the state detecting step 105.

Referring again to FIG. 3, the state detecting step 105 may be performed by the guide switch unit 150 and the dispensing switch unit 160.

The guide switch unit 150 detects a position of the dispensing unit 110, and the dispensing switch unit 160 detects a position of the dispensing button unit 120.

Accordingly, when an operation signal is transferred from the operation input step 101, first, an ON/OFF state of the guide switch unit 150 and the dispensing switch unit 160 is detected.

Referring to FIG. 5, if the guide switch unit 150 and the dispensing switch unit 160 are both detected to be in an ON state (105*a*), it is determined that the dispenser 100 is at the received position (105*c*) and corresponding information is provided to the driving step 106. If the guide switch unit 150 and the dispensing switch unit 160 are both detected to be in the OFF state (105*b*), it is determined that the dispenser 100 is at the dispensing position (105*d*) and corresponding information is provided to the driving step 106.

Referring again to FIG. 3, in the driving step 106, the dispenser 100 may be driven by the driving unit 130 based on the information received from the state detecting step 105.

Referring to FIG. 6, in a driving initiation step 106*a*, an operation initiation signal and a rotation direction signal of a motor are inputted based on the information received from the state detecting step 105.

Next, in driving completion steps 106*b* and 106*c*, the driving unit 130 is driven based on information received from the driving initiation step 106*a* and the driving step 106 is completed.

The driving completion steps 106*b* and 106*c* refer to the step 106*b* in which a time during which the driving unit 130 is driven and a pre-set time are compared, and the step 106*c* in which driving of the driving unit 130 is stopped if the driving time exceeds the pre-set time. Through the driving completion steps 106*b* and 106*c*, the movement operation of the dispenser 100 is completed.

Here, the completed state refers to the received position at which the dispenser 100 is received in the inner side of the door 13 and the dispensing position at which the dispenser 100 is ejected forwardly from the door 13.

Also, the pre-set time relates to the speed (or rate) at which the dispenser 100 moves between the dispensing position and the received position. Regarding the particular speed and based on the desire of consumers (users), experimental data obtained through various tests revealed that about 3 seconds may be appropriate. However, the particular speed may be set differently, according to various factors.

When the dispensing button unit 120 is pressed by the user at the dispensing position, ice, water, or the like is dispensed via the transfer unit 140 and the dispensing unit 110.

Ice or the like generally refers to a state of a dispensed material such as ice cubes, crushed ice, water, etc., which may be selected by the user through the operation button unit 170.

After ice or the like is completely dispensed at the dispensing position, if the operation button unit 170 is pressed, the operation input step 101 starts again, and as described above, the state detecting step 105 and the driving step 160 are sequentially performed to allow the dispenser 100 to move to the received position.

Figure 7:
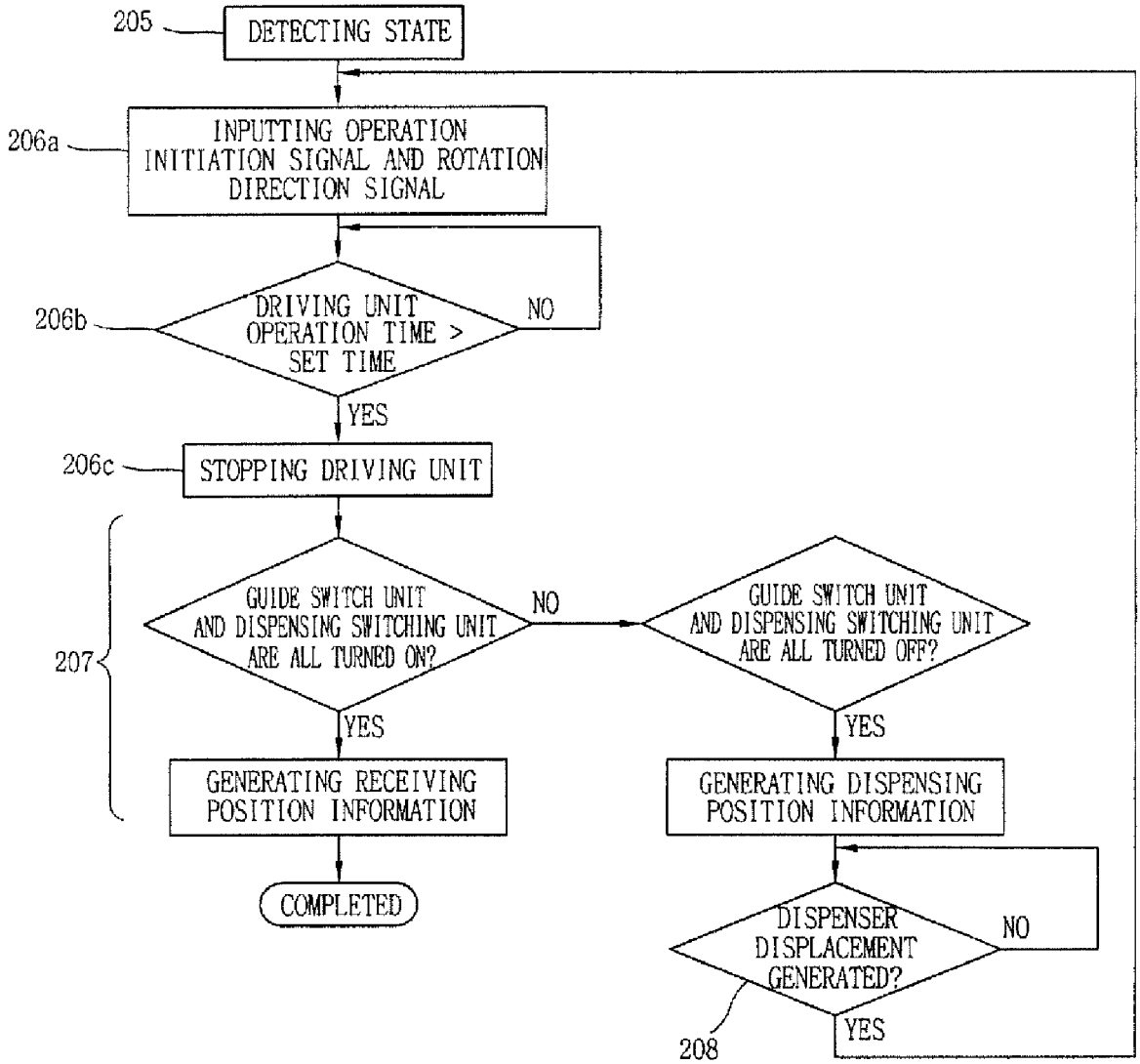

FIG. 7 illustrates a driving process of a method for controlling a refrigerator having a dispenser. In the following description, any structure and detailed description that would overlap with those already described above may be similar to the structure described above.

The method for controlling a refrigerator having a dispenser includes an operation input step, a state detecting step 205, and a driving step (206*a*, 206*b*, and 206*c*), which are similar to the operation input step 101, the state detecting step 105, and the driving step 106 described above.

With reference to FIG. 7, the driving step includes a driving initiation step 206*a* in which an operation initiation signal and a rotation direction signal of a motor are inputted based on information received from the state detecting step 205, a step 206*b* in which a time during which the driving unit is driven and a pre-set time are compared, and a step 206*c* in which driving of the driving unit is stopped if the driving time exceeds the pre-set time (steps 206*b* and 206*c* may be called driving completion steps).

In some implementations, the driving step further includes a step 207 in which a position of the dispenser is detected after the driving completion steps 206*b* and 206*c*, and a step 208 in which if the dispenser is detected to be at the dispensing position, it is checked whether the dispenser has been displaced by an external force 208, and if the dispenser has been displaced, a command for driving the dispenser to the received position is transferred to the driving initiation step 206*a*.

If the dispenser is detected to be at the received position, the driving unit is maintained in the stop state to thus complete the driving step 206.

Accordingly, when the dispenser is at the dispensing position, if the is dispensing unit is forcibly moved to the received position by an external force, the displacement of the dispensing unit is detected 208 and the driving unit is driven to force the dispenser to move to the received position.

Accordingly, there may be an advantage that ice or the like being improperly dispensed away from the container (or cup), due to abnormal movement of the dispensing unit with an external force applied thereto when the dispenser is at the dispensing position (or state), may be effectively reduced (e.g., prevented).

Figure 8:
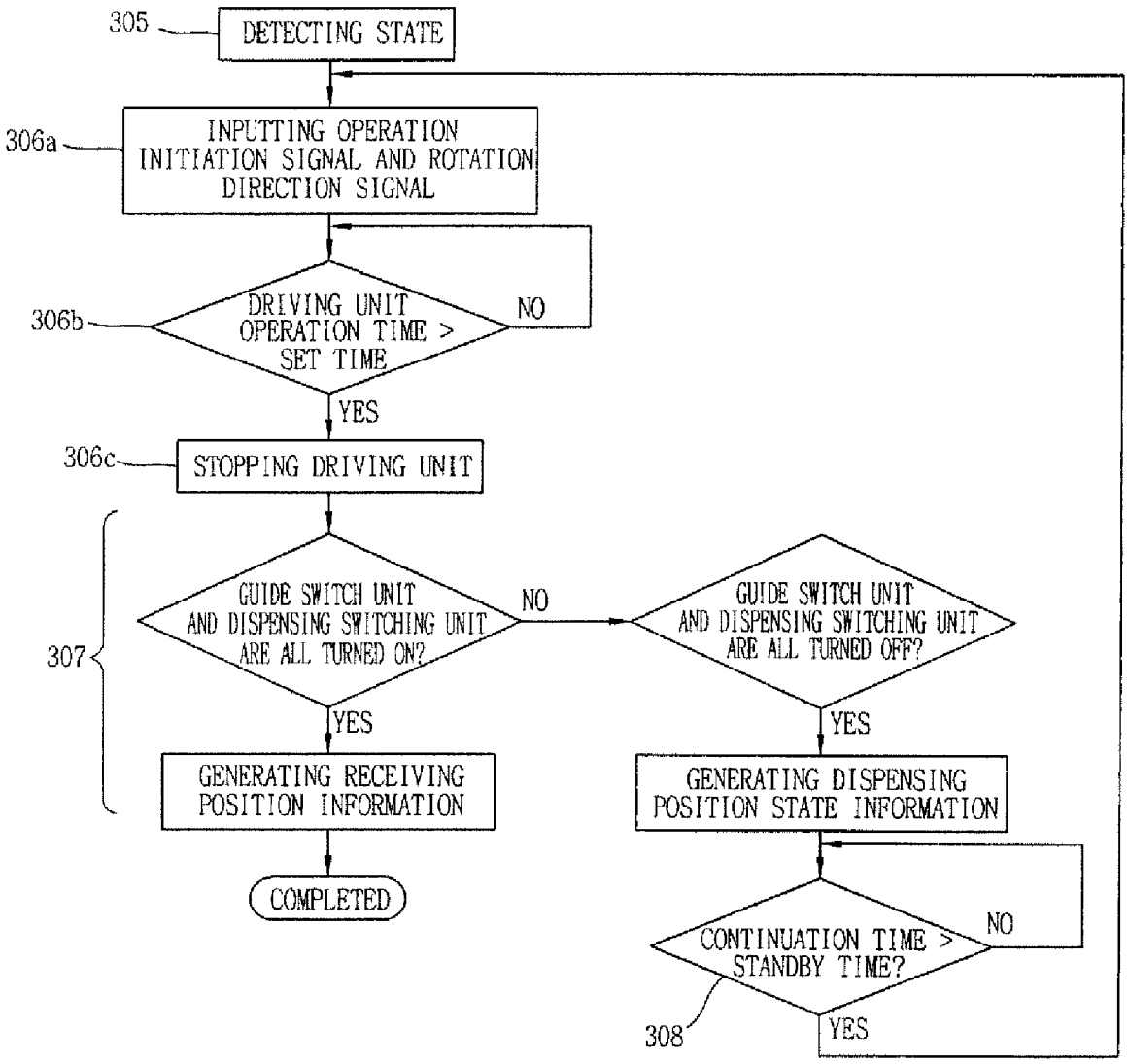

FIG. 8 illustrates a driving process of a method for controlling a refrigerator having a dispenser. In the following description, any structure and detailed description that would overlap with those already described above may be similar to the structure described above.

The method for controlling a refrigerator having a dispenser includes an operation input step, a state detecting step 305, and a driving step (306*a*, 306*b*, and 306*c*), which are similar to the operation input step 101, the state detecting step 105, and the driving step 106 described above.

The driving step includes a driving initiation step 306*a* in which an operation initiation signal and a rotation direction signal of a motor are inputted based on information received from the state detecting step 305, a step 306*b* in which a time during which the driving unit is driven and a pre-set time are compared, and a step 306*c* in which driving of the driving unit is stopped if the driving time exceeds the pre-set time.

With reference to FIG. 8, the driving step further includes a step 307 in which a position of a dispenser is detected; and a step 308 in which if the dispenser is detected to be at the dispensing position, a continuation time during which the dispenser stays at the dispensing position without a dispensing operation and a pre-set standby time are compared, and if the continuation time exceeds the standby time, a command for driving the dispenser to the received position is transferred to the driving initiation step 306*a*.

Based on the usage pattern of consumers (users), the standby time may be set to be about 30 seconds. Other standby times may be used based on the preference of a user.

If the dispenser is detected to be at the received position, the driving unit is maintained in a stop state (pause) to thus complete the driving step 306.

Accordingly, if the dispenser remains at the dispensing position without performing a dispensing operation for more than the certain standby time, the dispenser is returned to the received position, whereby the interior of the dispenser via the dispensing unit can be prevented and internal cooling air can be prevented from being leaked via the dispensing unit.

Figure 9:
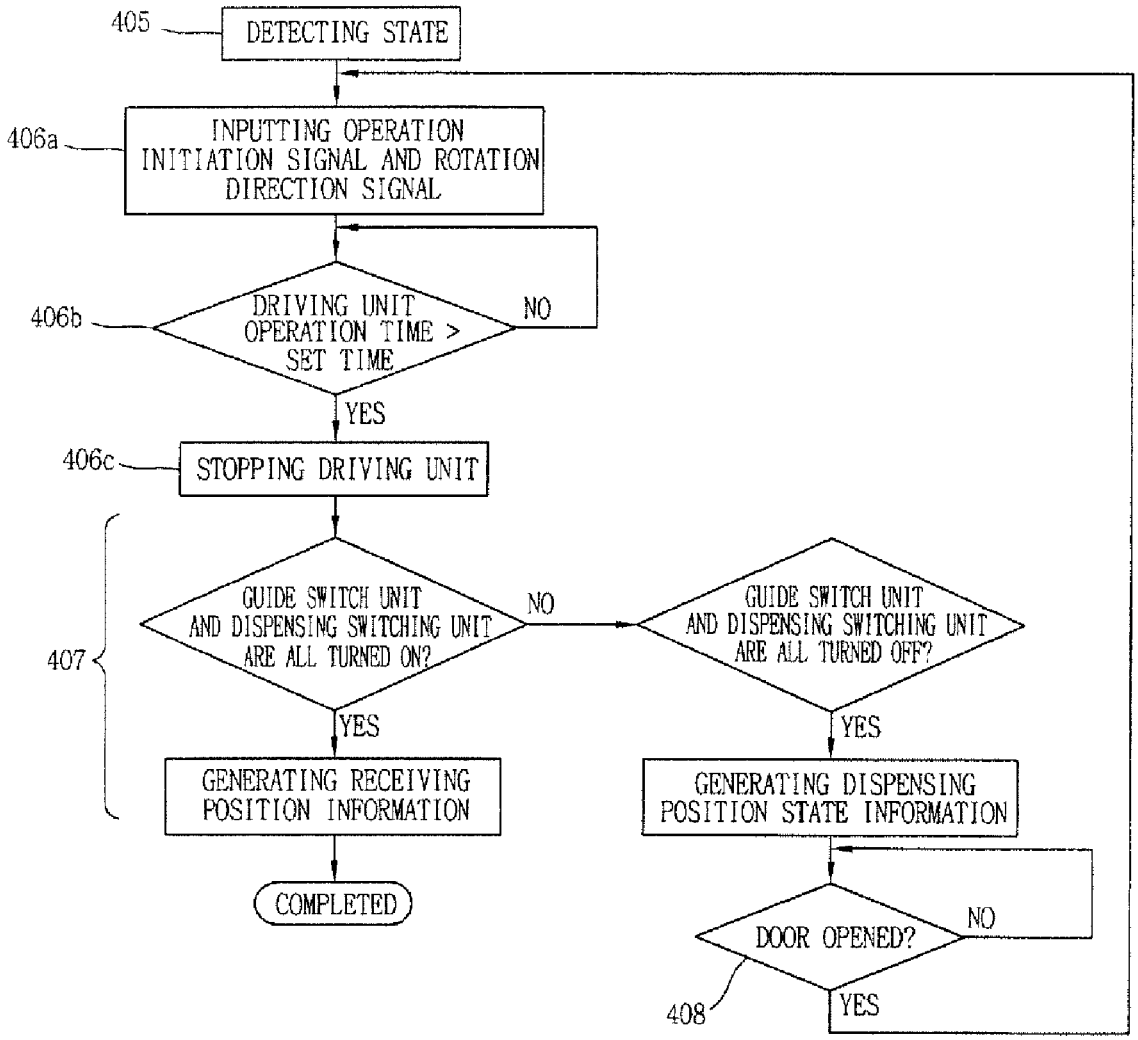

FIG. 9 illustrates a driving process of a method for controlling a refrigerator having a dispenser. In the following description, any structure and detailed description that would overlap with those already described above may be similar to the structure described above.

The method for controlling a refrigerator having a dispenser a includes an operation input step, a state detecting step 405, and a driving step (406*a*, 406*b*, and 406*c*), which are similar to the operation input step 101, the state detecting step 105, and the driving step 106 described above.

The driving step includes a driving initiation step 406*a* in which an operation initiation signal and a rotation direction signal of a motor are inputted based on information received from the state detecting step 405, a step 406*b* in is which a time during which the driving unit is driven and a pre-set time are compared, and a step 406*c* in which driving of the driving unit is stopped if the driving time exceeds the pre-set time.

With reference to FIG. 9, the driving step further includes a step 407 in which a position of a dispenser is detected; and a step 408 in which if the dispenser is detected to be at the dispensing position, it is detected whether or not the door 13 supporting the dispenser is open, and if the door is detected to be open, a command for driving the dispenser to the received position is transferred to the driving initiation step 406*a*.

If the dispenser is detected to be at the received position, the driving unit is maintained in a stop state (pause) to thus complete the driving step 406.

Accordingly, ice or the like may be prevented from being dispensed via the dispenser when the door 13 is opened, and thus, it can be ensured that ice or the like can be dispensed in a more stable manner such that consumer satisfaction is enhanced.

Figure 10:
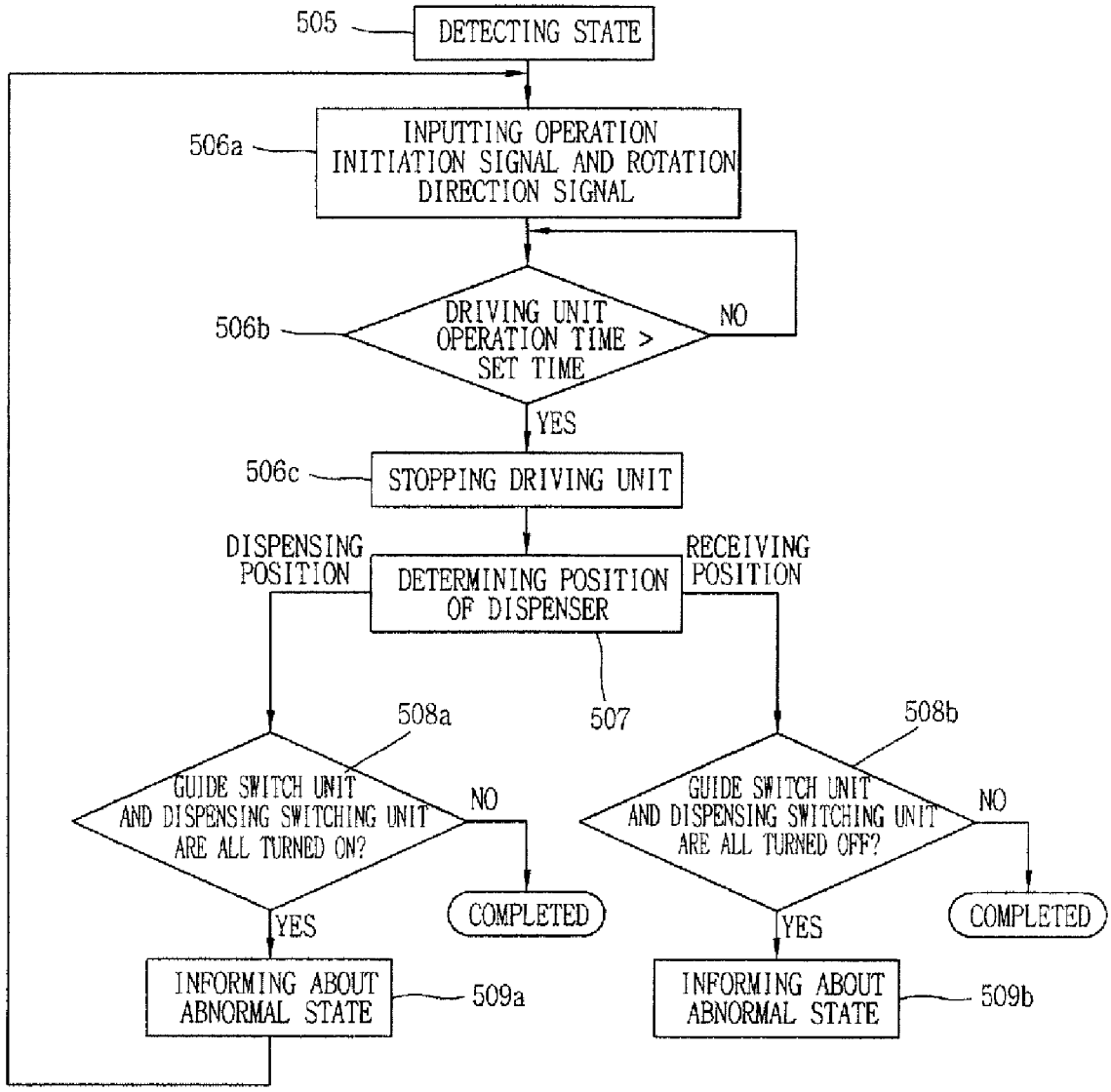

FIG. 10 illustrates a driving process of a method for controlling a refrigerator having a dispenser. In the following description, any structure and detailed description that would overlap with those already described above may be similar to the structure described above.

The method for controlling a refrigerator having a dispenser according to the fifth exemplary embodiment of the present invention includes an operation input step, a state detecting step 505, and a driving step (506*a*, 506*b*, and 506*c*), which are similar to the operation input step 101, the state detecting step 105, and the driving step 106 described above.

The driving step includes a driving initiation step 506*a* in which an operation initiation signal and a rotation direction signal of a motor are inputted based on information received from the state detecting step 505, a step 406*b* in which a time during which the driving unit is driven and a pre-set time are compared, and a step 506*c* in which driving of the driving unit is stopped if the driving time exceeds the pre-set time.

With reference to FIG. 10, in some implementations, the driving step includes a step 507 in which the position of the dispenser is determined after the step 506*c* in which the driving of the driving unit is stopped.

The position of the dispenser is determined based on information of the driving initiation step 506*a*, namely, an operation initiation signal and a rotation direction signal.

In some examples, the driving step includes a step 508*a* in which if the dispenser is determined to be at the dispensing position, it is detected whether or not the guide switch unit and the dispensing switch unit is in an OFF state, and a step 509*a* in which if at least one of the guide switch unit and the dispensing switch unit is detected to be in an ON state, a user is informed about detection of an abnormal state (e.g., a display or audible output is controlled to inform the user about the abnormal state). Further, the driving step may include a step in which a command for driving the dispenser to the received position is transferred to the driving initiation step 506*a*.

If the guide switch unit and the dispensing switch unit are all detected to be in an OFF state, the driving unit is maintained at the stop state to thus complete the driving step.

The driving step further includes: a step 508*b* in which if the dispenser is determined to be at the received position, it is detected whether or not the guide switch unit and the dispensing switch unit are in an ON state, and a step 509*b* in which if at least one of the guide switch unit and the dispensing switch unit are in an OFF state, a user is informed about detection of an abnormal state (e.g., a display or audible output is controlled to inform the user about the abnormal state).

If the guide switch unit and the dispensing switch unit are all detected to be in an ON state, the driving unit is maintained in a stop state (pause), to thus complete the driving step.

Accordingly, if the guide switch unit and/or the dispensing switch unit operate in an erroneous manner caused by debris or the like within the dispenser, such situation may be informed to the user, to thereby enhance consumer satisfaction.

In addition, because the inspection as to whether the product operates normally is performed after the dispenser is completely assembled, separate tools or equipment may not be needed to check whether the guide switch unit and the dispensing switch unit operate in a normal manner. Thus, product inspection may be more easily performed.

Figure 11:
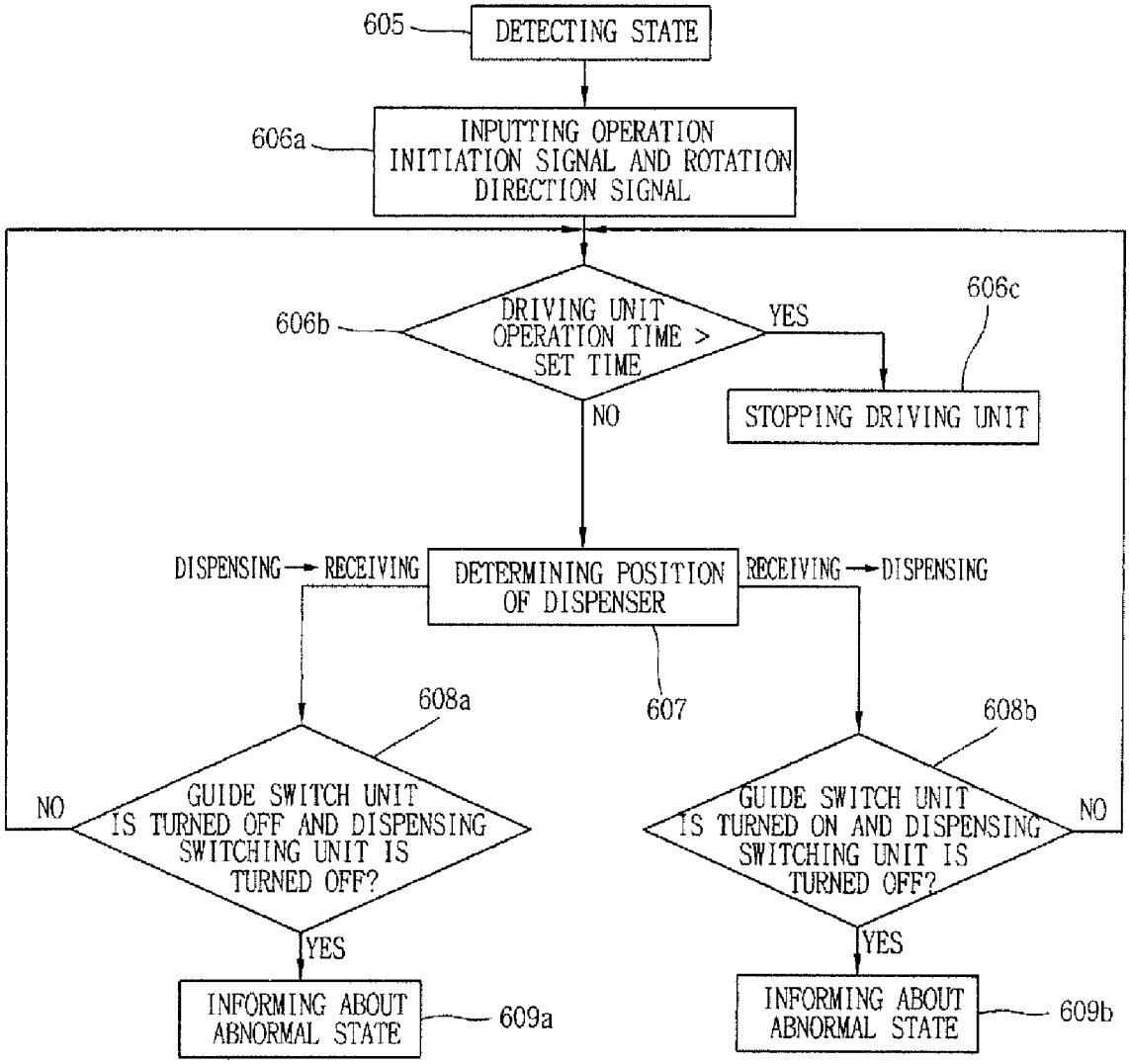

FIG. 11 illustrates a driving process of a method for controlling a refrigerator having a dispenser. In the following description, any structure and detailed description that would overlap with those already described above may be similar to the structure described above.

The method for controlling a refrigerator having a dispenser according to the sixth exemplary embodiment of the present invention includes an operation input step, a state detecting step 605, and a driving step (606*a*, 606*b*, and 606*c*), which are similar to the operation input step 101, the state detecting step 105, and the driving step 106 described above.

The driving step includes a driving initiation step 606*a* in which an operation initiation signal and a rotation direction signal of a motor are inputted based on information received from the state detecting step 605, a step 606*b* in which a time during which the driving unit is driven and a pre-set time are compared, and a step 606*c* in which driving of the driving unit is stopped if the driving time exceeds the pre-set time.

With reference to FIG. 11, the driving step includes a step 607 in which if the driving time doe not exceed the pre-set time, the operational direction of the dispenser is determined.

The operational direction of the dispenser may be determined based on information of the driving initiation step 606*a*, namely, an operation initiation signal and a rotation direction signal.

In some implementations, the driving step includes a step 608*a* in which if it is determined that the operational direction of the dispenser is from the dispensing position to the received position, it is detected whether or not the guide switch unit is in an OFF state or whether or not the dispensing switch unit is in an ON state by a certain period, and a step 609*a* in which, if appropriate, a user is informed about detection of an abnormal state (e.g., a display or audible output is controlled to inform the user about the abnormal state).

If the guide switch unit is not in an OFF state and the dispensing switch unit is not in an ON state, a step 606*b* of comparing a time during which the driving unit is driven and the pre-set time is performed.

The driving step also includes a step 608*b* in which if it is determined that the operational direction of the dispenser is from the received position to the dispensing position, it is detected whether or not the guide switch unit is in an ON state and whether or not the dispensing switch unit is in an OFF state, and a step 609*b* in which, if appropriate, a user is informed about detection of an abnormal state (e.g., a display or audible output is controlled to inform the user about the abnormal state).

If the guide switch unit is not in an ON state and the dispensing switch unit is not in an OFF state, the step 606*b* of comparing a time during which the driving unit is driven and the pre-set time is performed again.

Accordingly, if the guide switch unit and/or the dispensing switch unit operate in an erroneous manner caused by debris or the like within the dispenser, such situation is informed to the user, to thereby enhance consumer satisfaction. In addition, because the inspection as to whether the product operates normally is performed after the dispenser is completely assembled, separate tools or equipment may not needed to check whether the guide switch unit and the dispensing switch unit operate in a normal manner. Thus, product inspection may be more easily performed.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A method for controlling a refrigerator having a dispenser that includes a dispensing unit that is configured to move between a received position at which a dispenser outlet of the dispensing unit is positioned on a side of a surface of a refrigerator door where a compartment opened and closed by the refrigerator door is positioned and a dispensing position at which the dispenser outlet of the dispensing unit is positioned on a side of the surface of the refrigerator door opposite of the compartment, the method comprising:

receiving user input related to moving the dispensing unit between the received position and the dispensing position;

detecting whether the dispensing unit is oriented in the received position or the dispensing position; and driving the dispensing unit based on the user input and the detection of whether the dispensing unit is oriented in the received position or the dispensing position, including at least one of:

driving the dispensing unit from the received position to the dispensing position based on detecting that the dispensing unit is oriented in the received position, and driving the dispensing unit from the dispensing position to the received position based on detecting that the dispensing unit is oriented in the dispensing position.

2. The method of claim 1, wherein driving the dispensing unit comprises:

determining a rotation direction signal based on whether the dispensing unit is oriented in the received position or the dispensing position; and transferring an operation initiation signal and the rotation direction signal to a driving unit that is configured to drive the dispensing unit.

3. The method of claim 2, wherein determining a rotation direction signal based on whether the dispensing unit is oriented in the received position or the dispensing position comprises:

conditioned on detecting that the dispensing unit is oriented in the received position, determining a first rotation direction signal that is configured to inspire rotation, by the driving unit, of the dispensing unit in a direction from the received position to the dispensing position; and conditioned on detecting that the dispensing unit is oriented in the dispensing position, determining a second rotation direction signal that is configured to inspire rotation, by the driving unit, of the dispensing unit in a direction from the dispensing position to the received position.

4. The method of claim 1 wherein:

receiving user input related to moving the dispensing unit between the received position and the dispensing position comprises receiving at least one of a user input command to move the dispensing unit to the dispensing position and a user input command to move the dispensing unit to the received position; and driving the dispensing unit based on the user input and the detection of whether the dispensing unit is oriented in the received position or the dispensing position includes at least one of:

driving the dispensing unit from the received position to the dispensing position based on receiving the user input command to move the dispensing unit to the dispensing position and detecting that the dispensing unit is oriented in the received position, driving the dispensing unit from the dispensing position to the received position based on receiving the user input command to move the dispensing unit to the received position and detecting that the dispensing unit is oriented in the dispensing position, maintaining the dispensing unit in the dispensing position without driving the dispensing unit based on receiving the user input command to move the dispensing unit to the dispensing position and detecting that the dispensing unit is oriented in the dispensing position, and maintaining the dispensing unit in the received position without driving the dispensing unit based on receiving the user input command to move the dispensing unit to the received position and detecting that the dispensing unit is oriented in the received position.

5. The method of claim 4 wherein:

receiving user input related to moving the dispensing unit between the received position and the dispensing position comprises receiving a user input command to move the dispensing unit to the dispensing position;

detecting whether the dispensing unit is oriented in the received position or the dispensing position comprises detecting that the dispensing unit is oriented in the dispensing position; and driving the dispensing unit based on the user input and the detection of whether the dispensing unit is oriented in the received position or the dispensing position comprises maintaining the dispensing unit in the dispensing position without driving the dispensing unit based on receiving the user input command to move the dispensing unit to the dispensing position and detecting that the dispensing unit is oriented in the dispensing position.

6. The method of claim 4 wherein:

receiving user input related to moving the dispensing unit between the received position and the dispensing position comprises receiving a user input command to move the dispensing unit to the received position;

detecting whether the dispensing unit is oriented in the received position or the dispensing position comprises detecting that the dispensing unit is oriented in the received position; and driving the dispensing unit based on the user input and the detection of whether the dispensing unit is oriented in the received position or the dispensing position comprises maintaining the dispensing unit in the received position without driving the dispensing unit based on receiving the user input command to move the dispensing unit to the received position and detecting that the dispensing unit is oriented in the received position.

7. The method of claim 4 wherein:

receiving user input related to moving the dispensing unit between the received position and the dispensing position comprises receiving a user input command to move the dispensing unit to the dispensing position;

detecting whether the dispensing unit is oriented in the received position or the dispensing position comprises detecting that the dispensing unit is oriented in the received position; and driving the dispensing unit based on the user input and the detection of whether the dispensing unit is oriented in the received position or the dispensing position comprises driving the dispensing unit from the received position to the dispensing position based on receiving the user input command to move the dispensing unit to the dispensing position and detecting that the dispensing unit is oriented in the received position.

8. The method of claim 4 wherein:

receiving user input related to moving the dispensing unit between the received position and the dispensing position comprises receiving a user input command to move the dispensing unit to the received position;

detecting whether the dispensing unit is oriented in the received position or the dispensing position comprises detecting that the dispensing unit is oriented in the dispensing position; and driving the dispensing unit based on the user input and the detection of whether the dispensing unit is oriented in the received position or the dispensing position comprises driving the dispensing unit from the dispensing position to the received position based on receiving the user input command to move the dispensing unit to the received position and detecting that the dispensing unit is oriented in the dispensing position.

9. The method of claim 1, wherein receiving user input related to moving the dispensing unit between the received position and the dispensing position comprises at least one of detecting whether the dispensing unit has been moved by an external force when the dispenser is oriented in the dispensing position and receiving a signal from an operation button unit located on a surface of the refrigerator door or the dispensing unit that is opposite of the compartment.

10. The method of claim 9, wherein:

receiving user input related to moving the dispensing unit between the received position and the dispensing position comprises detecting whether the dispensing unit has been moved by an external force when the dispenser is oriented in the dispensing position; and driving the dispensing unit comprises, in response to detecting that dispensing unit has been moved by an external force when the dispenser is oriented in the dispensing position, transferring a driving command to a driving unit that instructs the driving unit to move the dispensing unit to the received position.

11. The method of claim 9, wherein receiving the user input comprises receiving a signal from an operation button unit located on a surface of the refrigerator door or the dispensing unit that is opposite of the compartment.

12. The method of claim 1, further comprising:

if the dispenser is detected to be oriented in the dispensing position:

measuring an idle time during which the dispensing unit is oriented in the dispensing position and content has not been dispensed by the dispensing unit;

accessing a stored threshold standby time;

comparing the idle time to the stored threshold standby time; and conditioned on the comparison revealing that the idle time is greater than the access threshold standby time, transferring a driving command to a driving unit that instructs the driving unit to move the dispensing unit to the received position.

13. The method of claim 1, further comprising:

detecting whether or not the refrigerator door is opened when the dispensing unit is detected to be oriented in the dispensing position; and conditioned on detecting that the refrigerator door is opened when the dispensing unit is detected to be oriented in the dispensing position, transferring a driving command to a driving unit that instructs the driving unit to move the dispensing unit to the received position.

14. The method of claim 1, wherein detecting whether the dispensing unit is oriented in the received position or the dispensing position comprises sensing whether a guide switch unit, that is activated by rotation of the dispensing unit moving between the received position and the dispensing position, is on or off, and sensing whether a dispensing switch unit, that is activated by a dispensing button unit configured to move, along with the dispensing unit, between the received position at which the dispensing button unit is positioned on the side of the surface of the refrigerator door where the compartment is positioned and the dispensing position at which at least a portion of the dispensing button is positioned on the side of the surface of the refrigerator door opposite of the compartment, is on or off.

15. The method of claim 14, wherein detecting whether the dispensing unit is oriented in the received position or the dispensing position further comprises determining that the dispensing unit is positioned at the received position when the guide switch unit and the dispensing switch unit are sensed to be on, and determining that the dispensing unit is positioned at the dispensing position when the guide switch unit and the dispensing switch unit are sensed to be off.

16. The method of claim 14, wherein driving the dispensing unit comprises:

transferring an operation initiation signal and a rotation direction signal to a driving unit that is configured to drive the dispensing unit;

accessing a stored threshold time; and stopping the driving unit if an operation time of the driving unit exceeds the accessed threshold time.

17. The method of claim 16, further comprising:

after stopping the driving unit, determining an expected position of the dispensing unit based on the rotation direction signal;

detecting a state of the guide switch unit and a state of the dispensing switch unit; and determining whether the dispensing unit is positioned at the expected position based on the detected states of the guide switch unit and the dispensing switch unit.

18. The method of claim 17, further comprising determining that the dispensing unit is positioned in an unexpected position if the dispensing unit is expected to be oriented in the received position and at least one of the guide switch unit and the dispensing switch unit is detected to be in a state indicating that the dispensing unit is positioned at a position other than the received position.

19. The method of claim 17, further comprising determining that the dispensing unit is positioned in an unexpected position if the dispensing unit is expected to be oriented in the dispensing position and at least one of the guide switch unit and the dispensing switch unit is detected to be in a state indicating that the dispensing unit is positioned at a position other than the dispensing position.

20. The method of claim 19, further comprising:

in response to determining that the dispensing unit is positioned in an unexpected position, controlling the driving unit to move the dispensing unit to the received position.

21. The method of claim 16, wherein the driving step comprises:

determining an operational direction of the dispensing unit based on the rotation direction signal;

detecting a state of the guide switch unit and a state of the dispensing switch unit at a certain period prior to the driving time exceeding the accessed threshold time; and determining whether or not the dispensing unit is in an abnormal state based on the states of the guide switch unit and the dispensing switch unit and the operational direction of the dispensing unit.

22. The method of claim 21, wherein determining whether or not the dispensing unit is in an abnormal state comprises determining that the dispensing unit is in an abnormal state if the dispensing unit is moving from the dispensing position to the received position and a state of the dispensing switch unit changes before a state of the guide switch unit changes.

23. The method of claim 21, wherein determining whether or not the dispensing unit is in an abnormal state comprises determining that the dispensing unit is in an abnormal state if the dispensing unit is moving from the received position to the dispensing position and a state of the guide switch unit changes before a state of the dispensing switch unit changes.

24. A refrigerator comprising:

a compartment;

a refrigerator door configured to open and close at least a portion of the compartment;

a dispensing unit that is configured to move between a received position at which a dispenser outlet of the dispensing unit is positioned on a side of a surface of the refrigerator door where the compartment is positioned and a dispensing position at which the dispenser outlet of the dispensing unit is positioned on a side of the surface of the refrigerator door opposite of the compartment;

an input unit configured to receive user input related to moving the dispensing unit between the received position and the dispensing position;

a detection unit configured to detect whether the dispensing unit is oriented in the received position or the dispensing position; and a driving mechanism configured to drive the dispensing unit based on the user input and the detection of whether the dispensing unit is oriented in the received position or the dispensing position, including at least one of:

driving the dispensing unit from the received position to the dispensing position based on the detection unit detecting that the dispensing unit is oriented in the received position, and driving the dispensing unit from the dispensing position to the received position based on the detection unit detecting that the dispensing unit is oriented in the dispensing position.

25. A refrigerator comprising:

a compartment;

a refrigerator door configured to open and close at least a portion of the compartment;

a dispensing unit that is configured to move between a received position at which a dispenser outlet of the dispensing unit is positioned on a side of a surface of the refrigerator door where the compartment is positioned and a dispensing position at which the dispenser outlet of the dispensing unit is positioned on a side of the surface of the refrigerator door opposite of the compartment;

an input unit configured to receive user input related to moving the dispensing unit between the received position and the dispensing position;

means for detecting whether the dispensing unit is oriented in the received position or the dispensing position; and means for driving the dispensing unit based on the user input and the detection of whether the dispensing unit is oriented in the received position or the dispensing position, including at least one of:

driving the dispensing unit from the received position to the dispensing position based on detecting that the dispensing unit is oriented in the received position, and driving the dispensing unit from the dispensing position to the received position based on detecting that the dispensing unit is oriented in the dispensing position.

* * * * *